US007874944B2

(12) United States Patent
LoVine

(10) Patent No.: US 7,874,944 B2
(45) Date of Patent: Jan. 25, 2011

(54) WEIGHTED END CAP FOR LACROSSE STICK

(75) Inventor: Robert John LoVine, Simpsonville, SC (US)

(73) Assignee: Lax Advantage LLC, Simpsonville, SC (US)

( * ) Notice: Subject to any disclaimer, the term of this patent is extended or adjusted under 35 U.S.C. 154(b) by 61 days.

(21) Appl. No.: 12/080,398

(22) Filed: Apr. 2, 2008

(65) Prior Publication Data

US 2009/0253539 A1 Oct. 8, 2009

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/512, 505; D21/724
See application file for complete search history.

(56) References Cited

U.S. PATENT DOCUMENTS

| | | | | | |
|---|---|---|---|---|---|
| 2,051,083 | A * | 8/1936 | Hart | 473/297 |
| 2,782,035 | A * | 2/1957 | East | 473/297 |
| 3,075,768 | A * | 1/1963 | Karns | 473/297 |
| 3,606,327 | A * | 9/1971 | Gorman | 473/297 |
| 4,037,841 | A * | 7/1977 | Lewis, Jr. | 473/513 |
| 4,371,983 | A * | 2/1983 | Piotti, Jr. | 2/19 |
| 4,461,479 | A * | 7/1984 | Mitchell | 473/292 |
| 5,082,290 | A | 1/1992 | Tucker et al. | |
| 5,364,102 | A * | 11/1994 | Appledorn | 473/297 |
| 5,465,967 | A * | 11/1995 | Boeckenhaupt | 473/297 |
| 5,575,722 | A * | 11/1996 | Saia et al. | 473/300 |
| 5,655,980 | A * | 8/1997 | Nashif et al. | 473/520 |
| 5,716,289 | A * | 2/1998 | Okoneski | 473/297 |
| 5,766,088 | A * | 6/1998 | Severtsen | 473/297 |
| 6,117,028 | A | 9/2000 | You | |
| 6,988,968 | B2 | 1/2006 | Okamoto | |
| 7,108,616 | B2 | 9/2006 | Morrow et al. | |
| 7,261,641 | B2 | 8/2007 | Linder | |
| 7,267,619 | B1 * | 9/2007 | Pettis | 473/297 |
| 7,481,716 | B1 * | 1/2009 | Johnson | 473/297 |
| 2004/0248676 | A1 * | 12/2004 | Taylor et al. | 473/513 |
| 2005/0096159 | A1 * | 5/2005 | Houston et al. | 473/513 |

* cited by examiner

*Primary Examiner*—Gene Kim
*Assistant Examiner*—M Chambers
(74) *Attorney, Agent, or Firm*—J. Bennett Mullinax, LLC

(57) ABSTRACT

An end cap for a lacrosse stick is provided. The end cap includes a cover configured for being placed over at least a portion of a shaft of a lacrosse stick. The end cap also includes a weighted member carried by the cover and configured for being at least partially located within the shaft of the lacrosse stick when the cover is placed over at least a portion of the shaft of the lacrosse stick.

13 Claims, 5 Drawing Sheets

WEIGHTED END CAP FOR LACROSSE STICK

FIELD OF THE INVENTION

The present invention relates generally to lacrosse sticks. More particularly, the present application involves a weighted end cap for a lacrosse stick that functions to keep the center of gravity of the lacrosse stick at a point along the shaft when a ball is present in the head of the lacrosse stick.

BACKGROUND

Lacrosse is a contact sport in which players attempt to shoot a ball past a goaltender into a goal located on the playing field. All of the players, including the goaltender, carry a lacrosse stick. The lacrosse stick is used to catch, hold and then subsequently shoot the ball. Further, the lacrosse stick may be used by a defenseman to check an opposing player or attempt to knock the ball from his or her lacrosse stick.

A lacrosse stick is composed of a shaft with a head located on one end thereof. The head includes a frame with a generally open aperture that is covered by a mesh. The mesh is provided in such a manner that the ball may be caught or cradled therein. The shaft of the lacrosse stick is an elongated, hollow member made from a strong material such as aluminum, titanium or a composite. The shaft has a circumference that includes one or more flat surfaces in order to afford better gripping thereof. For example, the shaft may have an octagonal cross-sectional shape. The shaft is generally cut by the retailer of the lacrosse stick to a length desired by the user. An end cap is placed on the butt end of the lacrosse stick to prevent it from damaging other players or objects that come into contact therewith. The butt end of the lacrosse stick is the end of the shaft opposite the end to which the head is attached. The end cap is frictionally fit onto the butt end of the lacrosse stick and is made out of a soft material such as rubber.

In use, a player generally holds the lacrosse stick with one hand at the butt end of the shaft and the other hand at a point along the shaft proximate to the head of the lacrosse stick. This hand positioning allows the head of the lacrosse stick to be desirably positioned for catching, cradling, and sometimes throwing the ball. When no ball is present in the head, the center of gravity of the lacrosse stick is located generally at the same location as the hand of the player proximate to the head when holding the lacrosse stick. However, once a ball is present in the head, the center of gravity of the lacrosse stick is no longer present along the shaft but is instead located at some point within the head. It may become more difficult for a player to use the lacrosse stick when the center of gravity is located away from his or her hand. As such, there remains room for variation and improvement within the art.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended FIGS. in which.

Figure 1:
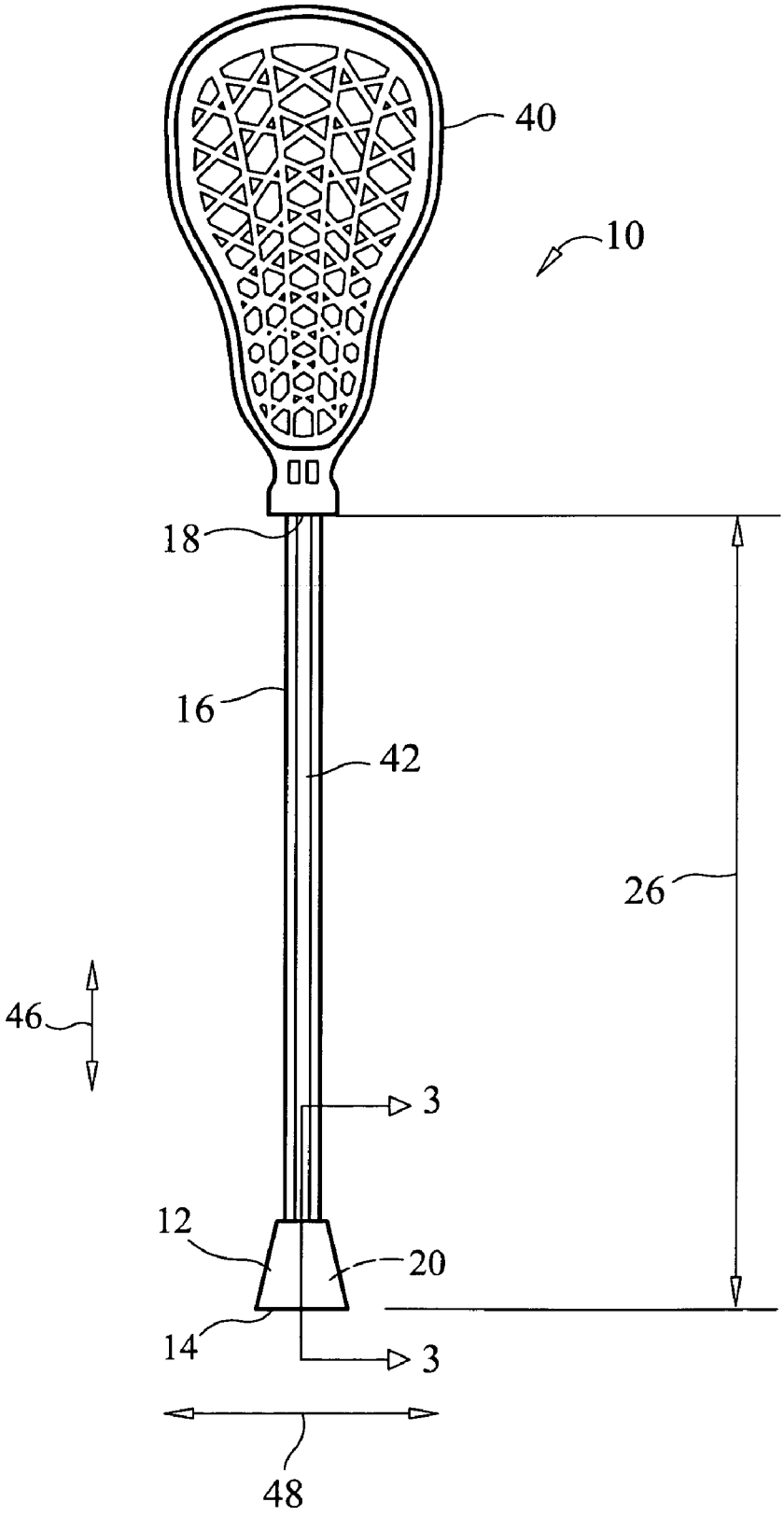
FIG. 1 a top view of a lacrosse stick without a ball in the head of the lacrosse stick in accordance with one exemplary embodiment.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for an end cap 12 for a lacrosse stick 10 that functions to shift the center of gravity 42 in the lengthwise direction 46 of the lacrosse stick 10 towards a butt end 20 of the shaft 16 of the lacrosse stick 10. The end cap 12 may be weighted so that the center of gravity 42 remains at some point along the shaft 16 of the lacrosse stick 10 when a ball 44 is present in the head 40 of the lacrosse stick 10. This arrangement may increase handling properties of the lacrosse stick 10 during use so that the player may more easily carry, shoot, or otherwise use the lacrosse stick 10 during play.

One exemplary embodiment of the lacrosse stick 10 is illustrated in FIG. 1. The lacrosse stick 10 includes a head 40 that has a generally open framework that is covered by a mesh. The mesh of head 40 may be made of a variety of materials such as leather or nylon and provides a means of deadening the impact of a tossed lacrosse ball 44 for capture. The head 40 also functions to hold the lacrosse ball 44 until such time the ball 44 is tossed therefrom. The head 40 is located at an end 18 of a shaft 16 of the lacrosse stick 10. The head 40 may be attached to end 18 in a variety of manners. For example, mechanical fasteners, adhesives or a friction fit may be employed to attached head 40 to end 18.

The shaft 16 is can be made of a material such as aluminum, titanium or a composite. Typically, the shaft 16 has a hollow interior 24 and a cross-sectional shape that includes one or more planar surfaces. For example, the cross-sectional shape of shaft 16 may be octagonal in shape. This shape may be beneficial in preventing slipping of the hands of the user off of the shaft 16 as the planar surfaces provide an improved gripping surface. However, it is to be understood that other arrangements are possible in which the shaft 16 may have a circular or oval outer surface or may not include a hollow interior 24.

Typically, the shaft 16 is cut by a retailer of the lacrosse stick 10 to a desired length. The length of the shaft 16 is dictated by the preference of the individual player using the lacrosse stick 10. Additionally, the length of the shaft 16 may be dictated by the rules of the league into which the player is affiliated. For example, certain leagues allow male lacrosse players to use a lacrosse stick that is of a longer length than the length allowed for female players. The shaft 16 can thus be cut at the butt end 20 so that the resulting shaft 16 is of a desired length. The lacrosse stick 10 is provided with an end cap 12 to cover the butt end 20 of the shaft 16 so that a user or object is not damaged by sharp edges that may be present on the butt end 20. The end cap 12 is typically made of a soft material to prevent damage to the hands of the user or to objects that may come into contact with the butt end 20. Additionally, the end cap 12 can be configured so that it has a surface that facilitates better gripping of the lacrosse stick 10 by a player. For example, the end cap 12 can have a larger outer circumference than the shaft 16 so that the user can more easily grasp the lacrosse stick or so that the hand of the user is prevented from sliding off of the butt end 20 of the shaft 16.

Figure 3:
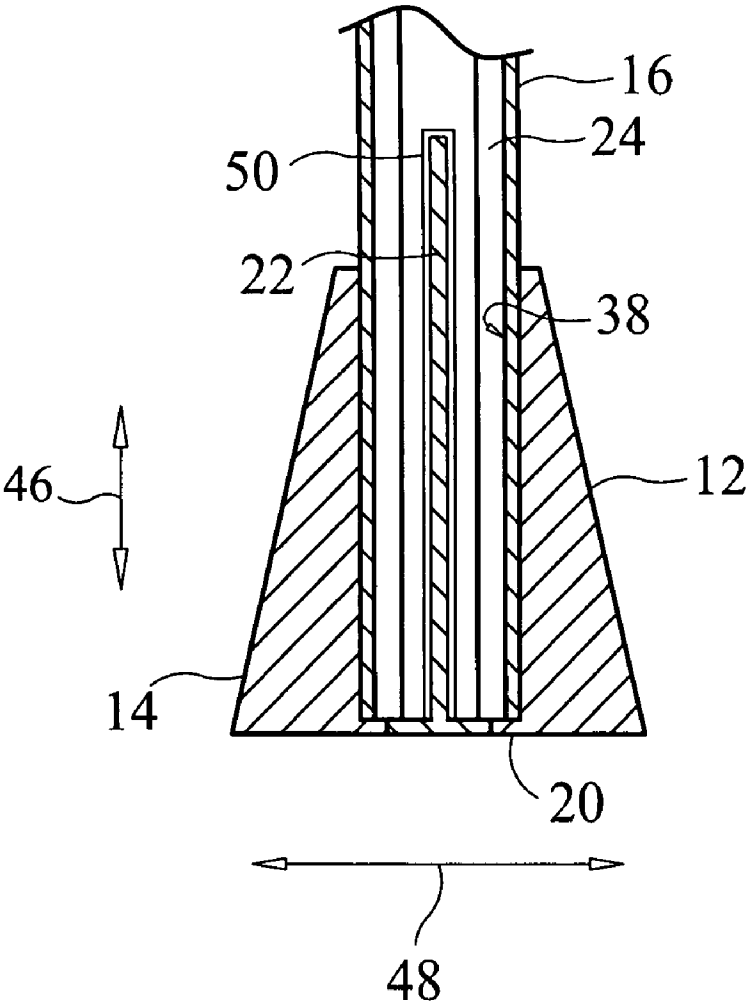
FIG. 3 is a cross-sectional view taken along line 3-3 of FIG. 1.

The end cap 12 is shown in greater detail with reference to FIG. 3. The end cap 12 includes a cover 14 that surrounds a portion of the shaft 16 at the butt end 20. The cover 14 thus functions to increase the ability of the user to grip the lacrosse stick 10 and to prevent damage through contact with the butt end 20 of the shaft 16. The cover 14 can be made out of a variety of materials in accordance with various exemplary embodiments. For example, the cover 14 may be made out of rubber or urethane in accordance with certain exemplary embodiments. The cover 14 may be sized and arranged so that it can be slipped over the butt end 20 of the shaft 16. In this manner, the cover 14 may be retained onto the butt end 20 through a frictional engagement. Should the user desire the removal of the end cap 12, the cover 14 can be pulled so that the frictional resistance between the cover 14 and the shaft 16 is overcome so that it can be detached therefrom. However, it is to be understood that the end cap 12 can be connected to the shaft 16 in a variety of manners in accordance with other exemplary embodiments. For example, the end cap 12 may be attached to the shaft 16 though the use of adhesives, tape or mechanical fasteners. Further, the end cap 12 may be arranged so that is not removable from the shaft 16. In this regard, the end cap 12 can be integrally formed with the shaft 16.

The end cap 12 also includes a weighted member 22. The weighted member 22 functions to add weight to the end cap 12 and can be made of a material that is harder and heavier than the cover 14. The weighted member 22 is attached to the cover 14 so that when the cover 14 is attached to the butt end 20, the weighted member 22 is positioned within the interior 24 of the shaft 16. The weighted member 22 can be attached to the cover 14 through a frictional engagement so that the weighted member 22 can be removed from and reattached to the cover 14. The weighted member 22 may be positioned in the interior 24 so that it does not touch or engage the inner surface 38 of the shaft 16. However, as stated the lacrosse stick 10 is used in a contact sport and experiences significant forces thereon. The weighted member 22 may vibrate or otherwise move in the interior 24 during normal use of the lacrosse stick 10. In this regard, a soft covering 50 can surround the weighted member 22 so that should the weighted member 22 shift up against the inner surface 38, metal to metal contact and a banging noise will not occur. This assumes of course that both the weighted member 22 and the shaft 16 in the previously mentioned exemplary embodiment are both made of metal. The soft covering 50 dampens this noise and vibration.

Referring back to FIG. 1, the lacrosse stick 10 has a lengthwise direction 46 along which the shaft 16 extends. The head 40 and end cap 12 are positioned on opposite ends of the shaft 16 in the lengthwise direction 46. The shaft 16 thus has a length 26 that extends in the lengthwise direction 46. The lacrosse stick 10 also has a transverse direction 48 that is at a right angle to the lengthwise direction 10. The lacrosse stick 10 has a center of gravity 42 in the lengthwise direction 46. The center of gravity 42 is located at a point along the length 26 of the shaft 16 such that the center of gravity 42 is located at the shaft 16. The center of gravity 42 represents a balance point of the lacrosse stick 10 in the lengthwise direction 46. The lacrosse stick 10 is generally symmetrical about an axis in the lengthwise direction 46 so that it has generally the same shape on opposite sides of its longitudinal axis.

Figure 2:
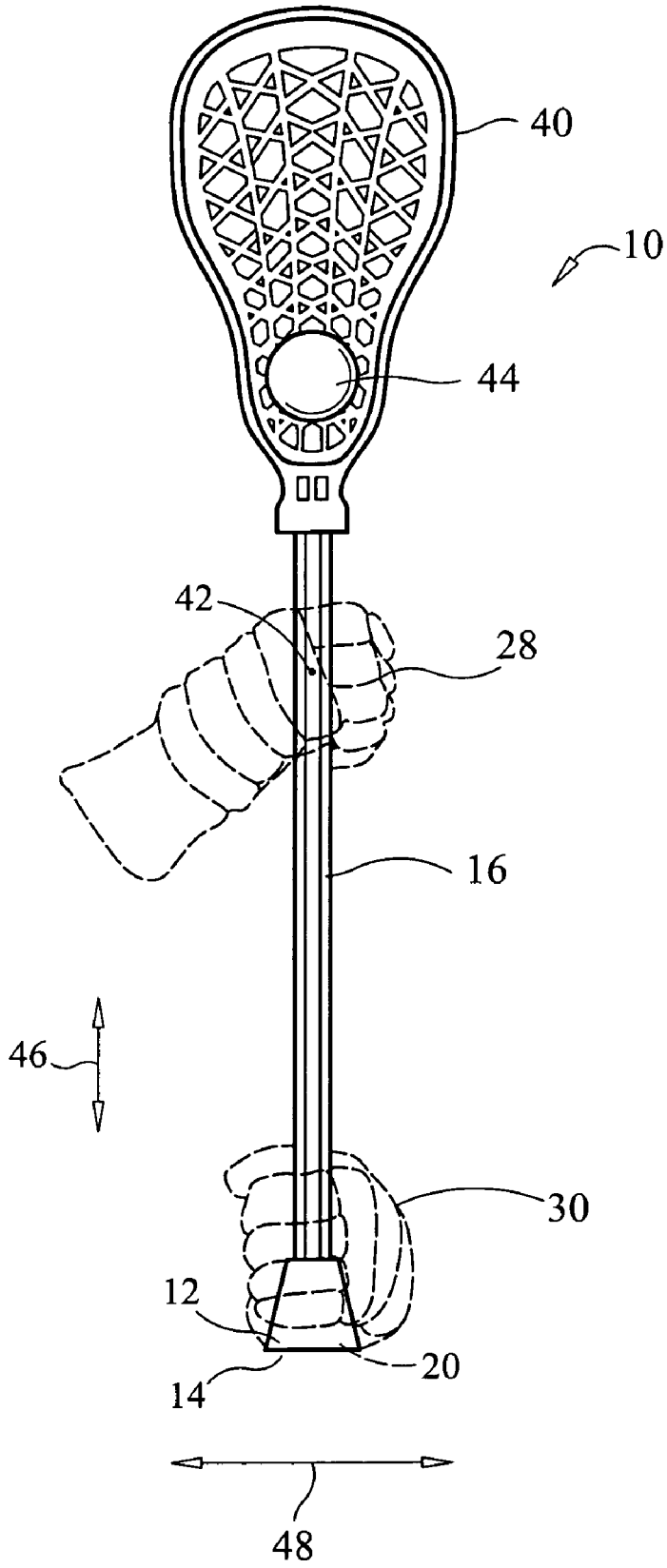
FIG. 2 is a top view of the lacrosse stick of FIG. 1 in which a ball is present in the head of the lacrosse stick so as to shift the center of gravity of the lacrosse stick in its lengthwise direction.

A ball 44 may be located in the head 40 during use of the lacrosse stick 10 as shown in FIG. 2. The ball 44 adds weight to the lacrosse stick 10 so that the center of gravity 42 is moved in the lengthwise direction 46 closer to the head 40. The presence of the weighted member 22 of the end cap 12 functions to maintain the location of the center of gravity 42 at a point along the length 26 of the shaft 16. Although the center of gravity 42 is moved in the lengthwise direction 46 to a point closer to the head 40, the center of gravity 42 is still maintained at a location along the shaft 16 and is not located in the head 40. The lacrosse stick 10 may be arranged so that the center of gravity 42 is at a point along the length 26 regardless of where the ball 44 is located on the head 40. However, other arrangements are possible such that the center of gravity 42 is located at a point in the head 40 when the ball 44 is at a location in head 40 at a point in the lengthwise direction 46 other than the location shown in the exemplary embodiment in FIG. 2.

Maintaining the center of gravity 42 at a point along the length 26 of the shaft 16 may provide improved handling properties of the lacrosse stick 10 during use. For example, the player may gain more control over the lacrosse stick 10 due to the fact that the perceived head 40 weight is lessened by the net effect of the counterbalance due to end cap 12. A goalkeeper may be able to move the head 40 at a faster rate due to the counterbalance of end cap 12 so that they can cover or block a shot in a faster manner. In accordance with certain exemplary embodiments, the center of gravity 42 can be located at a point along shaft 16 so that it is located where a hand 28 of the user grasps the shaft 16 proximate to head 40 during use of the lacrosse stick 10. The other hand 30 of the user is positioned at the butt end 20 of the lacrosse stick 10. Location of the center of gravity 42 at the hand 28 may afford better control of the lacrosse stick 10 during use. However, it is to be understood that the hand 28 may be moved from the location of the center of gravity 42 shown in FIG. 2 during normal use of the lacrosse stick 10. For example, hand 28 may be moved against or close to hand 30 when the ball 44 is shot from the lacrosse stick 10 in certain instances.

The weighted member 22 of the end cap 12 can be selected to be of any weight to provide a desired counterbalance to the lacrosse stick 10. For example, the weighted member 22 may be the same weight as the ball 44 used during play. Typically, the ball 44 weighs from 5 to 5.25 ounces. As such, the weighted member 22 of the end cap 12 can be from 5 to 5.25 ounces in certain exemplary embodiments. In accordance with other exemplary embodiments, the weighted member 22 may be from 5 to 15 ounces. In still other exemplary embodiments, the weighted member 22 may be up to 32 ounces. In yet other exemplary embodiments, the weighted member 22 may be from 2 to 10 ounces. In accordance with yet other exemplary embodiments, the weighted member may be from 2 to 15 ounces. It is to be understood that various exemplary embodiments exist in which the weighted member 22 can have any desired weight. In accordance with certain exemplary embodiments, the weighted member 22 may function to move the center of gravity 42 towards the butt end 20 any non-negligible amount. For example, the weighted member 22 may be selected so that the center of gravity 42 is moved one or more inches towards the butt end 20 through the presence of the end cap 12 with the weighted member 22 at the butt end 20. Use of a weighted member 22 that is similar to the weight of the ball 44 may result in increased control of the lacrosse stick 10 by the player that allows greater ease of passing and allows shooting of a greater velocity.

Referring back to FIG. 3, the end cap 12 is shown as being attached to the butt end 20 of the shaft 16 by way of a frictional engagement. In this regard, cover 14 is sized so that it can be forced over a portion of the shaft 16 at the butt end 20 and held thereon through friction between the cover 14 and the outer surface of the shaft 16. However, other means of attachment of the cover 14 are contemplated in accordance with other exemplary embodiments as previously discussed. The weighted member 22 extends from the cover 14 in the lengthwise direction 46. The weighted member 22 may extend an amount in the lengthwise direction 46 so that it does not extend past the hand 30 of the user in the lengthwise direction 46. In this regard, the end cap 12 does not extend beyond the hand 30 of the user at the butt end 20 during use of the lacrosse stick 10. However, other arrangements are possible in which the weighted member 22 does extend a length sufficient in the lengthwise direction 46 so that it extends beyond the point at which the hand 30 grasps the lacrosse stick 10 at the butt end 20. As used herein, the butt end 20 of the shaft 16 can be the outer, most distant edge of the shaft 16 in the lengthwise direction 46. Alternatively, the butt end 20 of the shaft 16 may also include some portion of the shaft 16 along the length 26 of the shaft 16 in the lengthwise direction 46. For example, the butt end 20 may include up to six inches of the length 26 of shaft 16 in the lengthwise direction 46.

Figure 4:
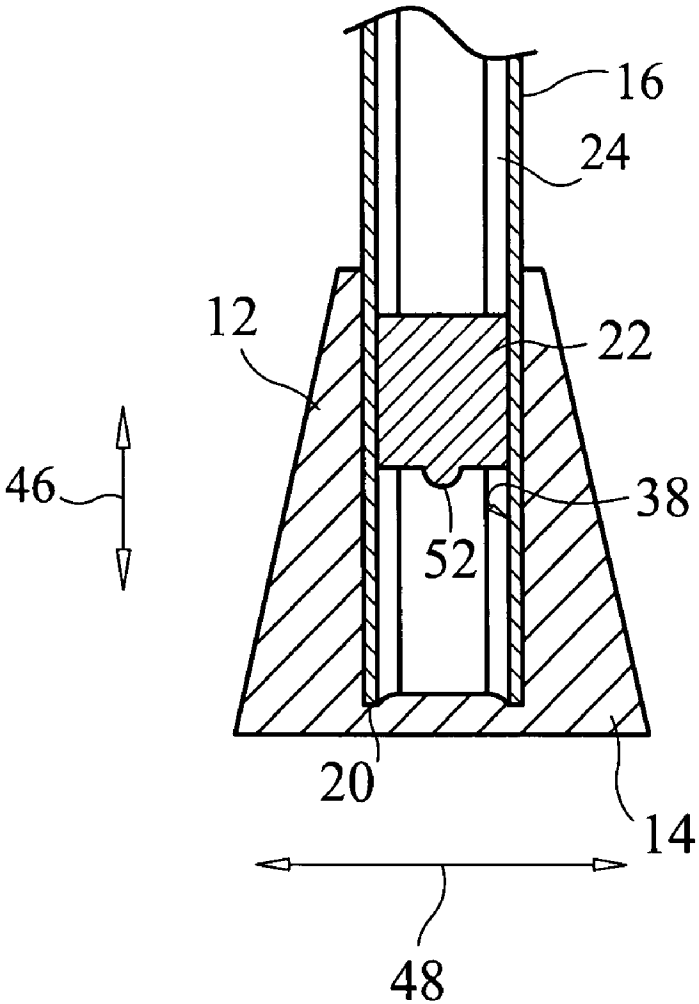
FIG. 4 is a cross-sectional view of an end cap in accordance with one exemplary embodiment.

The end cap 12 may be arranged differently in accordance with various exemplary embodiments. FIG. 4 illustrates an alternative exemplary embodiment of the end cap 12 in which the cover 14 and the weighted member 22 are separate components and are not attached to one another. The user may insert the weighted member 22 into the interior 24 of the shaft 16 at the butt end 20. The weighted member 22 can be sized and selected so that its position in the interior 24 is maintained due to a frictional engagement with the inner surface 38 of the shaft 16. Alternatively, the weighted member 22 may be retained in position in the interior 24 in a variety of manners. For example, the weighted member 22 may be maintained in position through the use of snap fasteners or adhesives. The weighted member 22 can have a soft deformable covering that functions to grip the inner surface 38. The weighted member 22 may have a tab 52 that can be grasped by a user and pulled in order to remove the weighted member 22 when desired. The cover 14 can be made of a soft, elastomeric material such as rubber and may be retained onto the butt end 20 in a variety of manners. For example, the cover 14 can be maintained onto the butt end 20 through a frictional engagement as previously discussed.

The end cap 12 may be arranged so that the weighted member 22 is covered from sight due to the shaft 16 and the cover 14. As such, the weighted member 22 may be inside of the shaft 16 and the cover 14 may be located on the butt end 20 so that one cannot see the weighted member 22 during use of the lacrosse stick 10. However, other arrangements are possible in which a portion of or all of the weighted member 22 is visible during use.

Figure 6:
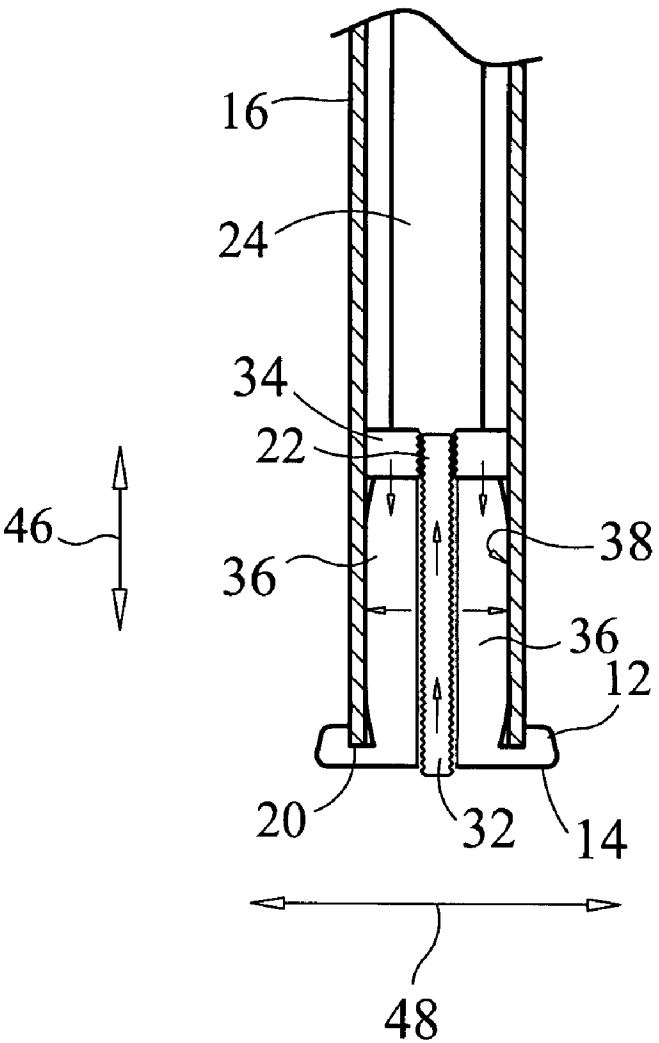
FIG. 6 is a cross-sectional view of the end cap of FIG. 5 in which the end cap is in an engaged position so as to be urged against the shaft.
Figure 5:
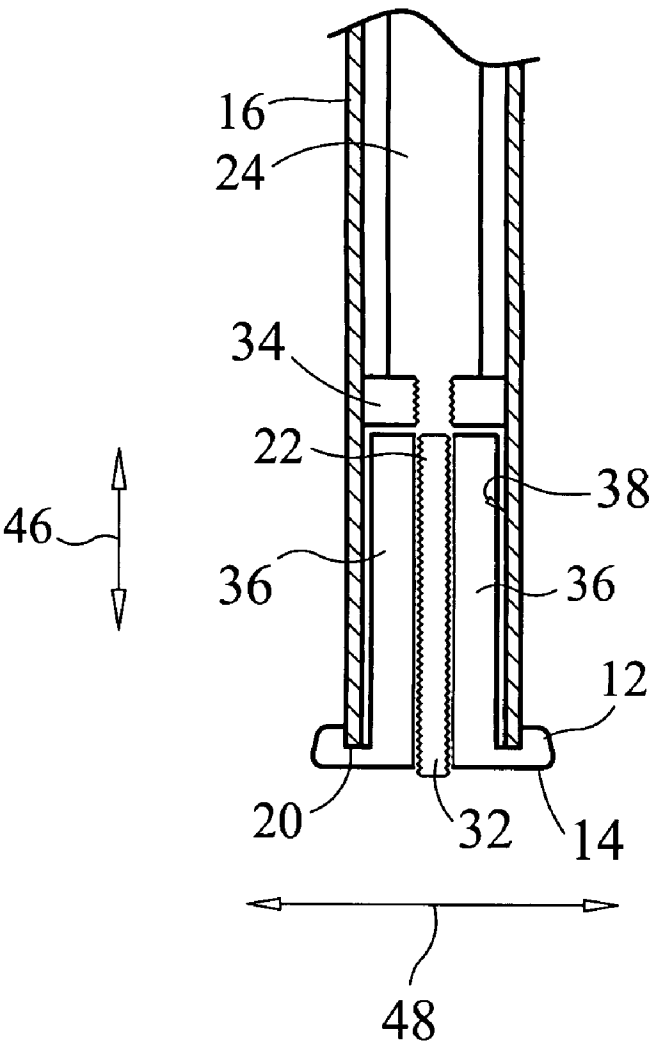
FIG. 5 is a cross-sectional view of an alternative exemplary embodiment of an end cap in a non-engaged position with a shaft.

An additional exemplary embodiment of the end cap 12 is illustrated in FIGS. 5 and 6. Here, the end cap 12 includes a weighted member 22 that has a screw 32 and a threaded nut 34. The screw 32 and/or threaded nut 34 may be selected so as to have a weight capable of shifting the center of gravity 42 of the lacrosse stick 10 towards the butt end 20 any desired amount. As such, the screw 32 and/or threaded nut 34 provides the necessary weight of the weighted member 22. The screw 32 is capable of engaging the threaded nut 34. The threaded nut 34 is selected so that it is wide enough to contact at least a portion of the inner surface 38. In the exemplary embodiment shown, the inner surface 38 in FIG. 5 is octagonal in shape and the threaded nut 34 is likewise octagonal and contacts the entire inner surface 38 about the circumference of the threaded nut 34. However, other arrangements are possible in which the threaded nut 34 engages only a single flat surface, or a pair of oppositely disposed flat surfaces, of the inner surface 38 of the shaft 16.

The cover 14 is integrally formed with a deformable gripping portion 36. The cover 14 and deformable gripping portion 36 may be made of the same or different materials in accordance with various exemplary embodiments. Also, although shown as being integrally formed, it is to be understood that the deformable gripping portion 36 may be attached to or may be a separate component from the cover 14 in accordance with other versions of the end cap 12. The deformable gripping portion 36 has a circumference that is sized so that it does not engage the inner surface 38 or only loosely engages the inner surface 38 so that the end cap 12 can be easily slid on and off of the shaft 16. However, it is to be understood that other arrangements are possible in which the cover 14 may be capable of being independently attached to the shaft 16 so that the end cap 12 cannot be easily slid therefrom due to loose contact between the deformable gripping portion 36 and the inner surface 38.

The screw 32 can be actuated so that it engages the threaded nut 34. The threaded nut 34 is prohibited from rotating due to its engagement with the inner surface 38. Rotation of the screw 32 thus causes the threaded nut 34 to travel along the length of the screw 32 as shown with reference to FIG. 6. The threaded nut 34 travels in the lengthwise direction 46 away from the head 40. This movement causes the deformable gripping portion 36 to be compressed. In turn, compression of the deformable gripping portion 36 functions to force this component against the inner surface 38 thus effecting a locking of the end cap 12 onto the shaft 16. Should removal of the end cap 12 be desired, the screw 32 can be rotated in an opposite direction so that the threaded nut 34 is moved away from the deformable gripping portion 36. This will cause the deformable gripping portion 36 to expand and thus reduce its grip against the inner surface 38. The arrangement between the screw 32, threaded nut 34 and the deformable gripping portion 36 may be a well nut or an arrangement similar to a well nut.

Figure 8:
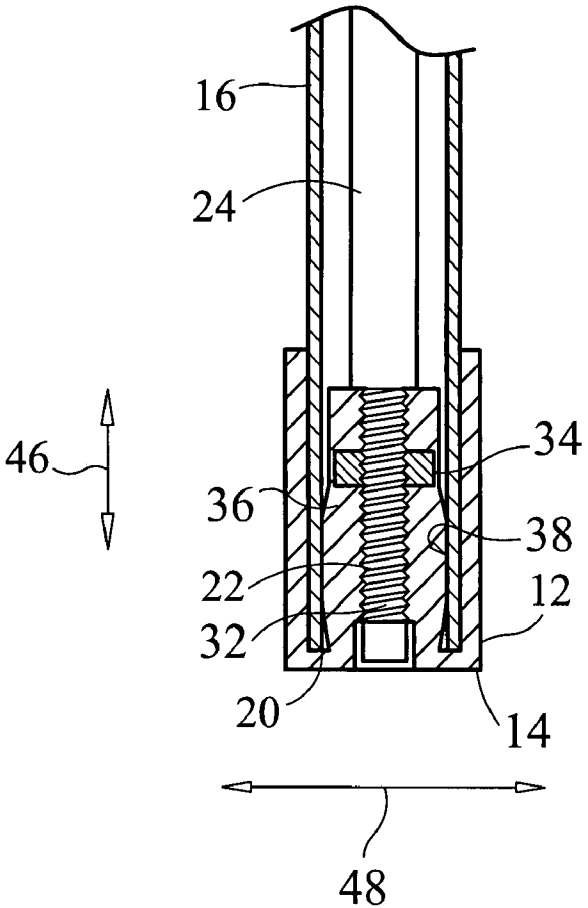
FIG. 8 is a cross-sectional view of the end cap of FIG. 7 in the engaged position so as to be urged against the shaft.
Figure 7:
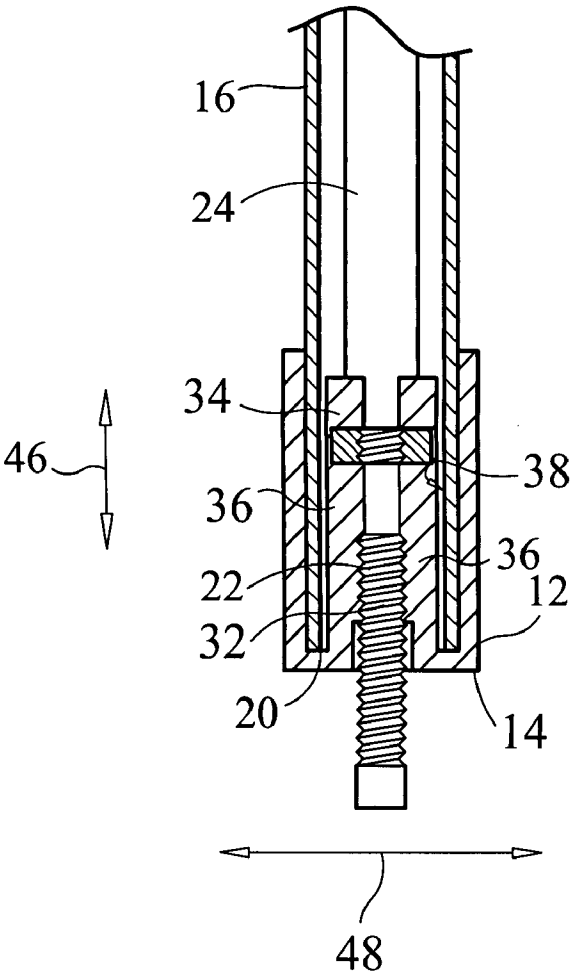
FIG. 7 is a cross-sectional view of an alternative exemplary embodiment of an end cap in a non-engaged position with the shaft.

An additional exemplary embodiment of the end cap 12 is shown in FIGS. 7 and 8. Although similar to the exemplary embodiment of FIGS. 5 and 6, the threaded nut 34 does not engage the inner surface 38 of the shaft 16. Additionally, the deformable gripping portion 36 is arranged so that it surrounds at threaded nut 34. The user may again position the end cap 12 onto the butt end 20. In this regard, the cover 14 may be selected so as to be capable of being attached to the shaft 16 through a frictional engagement. The user may then rotate the screw 32 so that it engages the threaded nut 34. Continued rotation of the screw 32 causes the threaded nut 34 to be moved in the lengthwise direction 46 of the lacrosse stick 10 away from the head 40. Movement of the threaded nut 34 causes compression and associated deformation of the deformable gripping portion 36 so that it bulges outward and engages the inner surface 38 thus locking the end cap 12 in place. The screw 32 can be rotated in an opposite direction so that this engaging force can be removed.

In use, the player may remove the end cap 12 or a component of the end cap 12 and replace same with an end cap 12 or component that has a different weight. In this manner, the balance point of the lacrosse stick 10 can be adjusted during a game or can be adjusted should a different player want to use the same lacrosse stick 10. As such, a variety of end caps 12 of different weights can be provided to the player so that a desired end cap 12 can be used at a particular point in time. Further, a number of different weighted members 22 that have varying weights can be provided to the user so that they can likewise be interchanged to effect a desired positioning of the center of gravity 42.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed:

1. An end cap for a lacrosse stick, comprising:

a cover configured for being placed over at least a portion of a shaft of a lacrosse stick;

a weighted member carried by the cover and configured for being at least partially located within the shaft of the lacrosse stick when the cover is placed over at least a portion of the shaft of the lacrosse stick, wherein the weighted member is selected so as to cause a center of gravity of the lacrosse stick and a ball to be located at a point along the shaft of the lacrosse stick when the ball is located in a head of the lacrosse stick during play;

a deformable gripping portion that is integrally formed with the cover such that the cover and the deformable gripping portion are a single component formed of the same material and that is located at least partially inside of the shaft when the cover and the weighted member are attached to the shaft of the lacrosse stick; and a threaded nut configured for engaging complimentary threading of the weighted member such that rotation of the weighted member causes movement of the threaded nut along the weighted member so as to deform the deformable gripping portion, wherein the cover is configured such that the deformable gripping portion acts to engage an inner surface of the shaft to aid in attachment of the cover and the weighted member to the shaft, wherein the treaded nut does not engage the inner surface of the shaft, and wherein when the weighted member is fully inserted into the shaft of the lacrosse stick the threaded nut and the deformable gripping portion and the cover surround the weighted member such that the threading of the weighted member is shielded from directly facing the inner surface of the shaft, wherein the cover contacts an outer surface of the shaft of the lacrosse stick, and wherein the threaded nut is positioned in a lengthwise direction of the shaft of the lacrosse stick such that a portion of the cover inside the shaft is closer to the head of the lacrosse stick in the lengthwise direction than the threaded nut and wherein a portion of the cover is located inside of the shaft and is closer to a head of the lacrosse stick in the lengthwise direction than the deformable gripping portion and the threaded nut, wherein when the deformable gripping portion engages the inner surface of the shaft the portion of the cover that is closer to the head does not engage the inner surface of the shaft and such that the only portion of the cover that engages the inner surface of the shaft is located beyond the threaded nut.

2. The end cap as set forth in claim 1, wherein when the cover and the weighted member are attached to the shaft of the lacrosse stick the weighted member is arranged so as not to extend along the length of the shaft beyond the cover such that a portion of the cover is located closer to a head of the lacrosse stick in a lengthwise direction than the weighted member.

3. The end cap as set forth in claim 1, wherein the weighted member is configured to be located completely inside of the shaft when the cover is placed over at least a portion of the shaft of the lacrosse stick.

4. The end cap as set forth in claim 1, wherein the weighted member weighs 4.9 ounces.

5. The end cap as set forth in claim 1, wherein the weighted member has a weight that is from two to fifteen ounces.

6. The end cap as set forth in claim 1, wherein at least a portion of the weighted member is made of a material that is harder than the cover.

7. A lacrosse stick used during the playing of a game of lacrosse, comprising:

a shaft;

a head located on one end of the shaft;

a cover located on a butt end of the shaft, wherein the butt end of the shaft is located opposite the end of the shaft to which the head is located; and a weighted member located with respect to the shaft so as to cause the center of gravity in the lengthwise direction of the lacrosse stick to be located at a point along the length of the shaft when a ball is present in the head, and wherein the weighted member is located with respect to the shaft so as to cause the center of gravity in the lengthwise direction of the lacrosse stick to be located at a point along the length of the shaft when the ball is not present in the head, wherein the weighted member is at least partially located inside of the shaft such that the entire portion of the weighted member that is located inside of the shaft has a constant length in a transverse direction of the lacrosse stick and does not contact an inner surface of the shaft; and a soft covering that completely surrounds the entire portion of the weighted member that is located inside of the shaft, wherein the soft covering contacts and covers all of the surfaces of the weighted member that are located within the shaft and does not contact and cover the surfaces of the weighted member located outside of the shaft and does not contact the cover, wherein an end portion of the weighted member is uncovered by the cover and the soft covering and is exposed for engagement by a user of the lacrosse stick during the playing of a game of lacrosse wherein the weighted member is located so as to be closer to the head of the lacrosse stick in the lengthwise direction than any portion of the cover.

8. The lacrosse stick as set forth in claim 7, wherein the weighted member is arranged so as not to extend along the length of the shaft beyond the hand of the user that is proximate to the butt end of the shaft when using the lacrosse stick.

9. The lacrosse stick as set forth in claim 7, wherein the weighted member is located at the butt end of the shaft.

10. The lacrosse stick as set forth in claim 7, wherein the cover and the weighted member are attached to one another.

11. The lacrosse stick as set forth in claim 7, wherein the cover and the weighted member are separate components.

12. The lacrosse stick as set forth in claim 7, wherein the shaft is hollow, and wherein the weighted member is located completely inside of the shaft, wherein the cover is placed over the butt end of the shaft such that the weighted member is completely covered by the cover and the shaft.

13. The lacrosse stick as set forth in claim 7, wherein the weighted member has a weight that is from two to fifteen ounces.

* * * * *

UNITED STATES PATENT AND TRADEMARK OFFICE

CERTIFICATE OF CORRECTION

PATENT NO. : 7,874,944 B2
APPLICATION NO. : 12/080398
DATED : January 25, 2011
INVENTOR(S) : Robert John LoVine It is certified that error appears in the above-identified patent and that said Letters Patent is hereby corrected as shown below:

In Claim 4 at col. 8 line 29, the number “4.9” should read --5--.
In Claim 7 at col. 8 line 42, the word “and” should be deleted.

Signed and Sealed this
Nineteenth Day of April, 2011

David J. Kappos

David J. Kappos
*Director of the United States Patent and Trademark Office*